US006846185B1

(12) United States Patent
Lan

(10) Patent No.: US 6,846,185 B1
(45) Date of Patent: Jan. 25, 2005

(54) BLIND MATING APPARATUS

(75) Inventor: Chi Feng Lan, Tai Chung Hsien (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/640,318

(22) Filed: Aug. 14, 2003

(51) Int. Cl.[7] ..... H01K 12/00
(52) U.S. Cl. ..... 439/66; 439/700; 439/824
(58) Field of Search ..... 439/700, 824, 439/66, 65, 289, 591, 76.1, 74

(56) References Cited

U.S. PATENT DOCUMENTS 4,988,308 A 1/1991 Toedtman ..... 439/248
5,256,073 A * 10/1993 Reymond et al. ..... 439/79
5,388,997 A * 2/1995 Grange et al. ..... 439/66
5,641,315 A * 6/1997 Swart et al. ..... 439/824
6,043,666 A * 3/2000 Kazama ..... 324/754
6,166,615 A * 12/2000 Winslow et al. ..... 333/260
6,447,343 B1 * 9/2002 Zhang et al. ..... 439/700

* cited by examiner

*Primary Examiner*—Tho D. Ta
*Assistant Examiner*—X. Chung-Trans
(74) *Attorney, Agent, or Firm*—Birch, Stewart, Kolasch & Birch, LLP

(57) ABSTRACT

A blind mating apparatus used in an expansion system has a first printed circuit board (PCB) and a second PCB. The first PCB has a resilient member and a housing sleeving the resilient member, and the second PCB has a contact member electrically connecting the resilient member. The blind mating apparatus further has a guiding member for guiding the resilient member and through which the resilient member penetrates. The contact member has a tolerance for correctly mating with the resilient member while the resilient member provides the contact member with a little bias.

27 Claims, 5 Drawing Sheets

BLIND MATING APPARATUS

BACKGROUND OF THE INVENTION

1. Field of the Invention

The present invention relates to a blind mating apparatus. More particularly, the present invention relates to a blind mating apparatus adopted for an expanding paper drawer.

2. Description of Related Art

Referring to FIG. 1, a prior art office peripheral system 30*a*, which includes a printer, a copier, a fax machine and so on, utilizes one expanding paper drawer 40*a*, satisfying a user for paper size and paper requirement. A way of connection between one expanding paper drawer 40*a* and another expanding paper drawer 40*a* or one expanding paper drawer 40*a* and the prior art office peripheral system 30*a* is to employ a couple of blind mating connectors, each having a tolerance for correctly mating for each other when one blind mating connector provides a little bias to the other blind mating connector.

U.S. Pat. No. 4,988,308 discloses a blind mating connector characterized by a minor cross sectional dimension of a connecting terminal less than a diameter of a corresponding aperture for vertically guiding the connecting terminal to insert into the corresponding aperture. However, the blind mating connector further includes a pair of helical vanes fixed on a panel for mounting the blind mating connector on the panel in an external way. Manufacturing assembly of the blind mating connector requires many complex steps, much manufacturing time, and cannot reduce manufacturing costs. Also, the blind mating connector has a fixed numbers of terminals and conducting pads, a numbers of fixed distances each between the conducting pads, and a fixed volume thereof, such that the blind mating connector cannot be further adjusted.

SUMMARY OF THE INVENTION

A primary object of the present is to provide a blind mating apparatus utilizing a printed circuit board (PCB) mating with a spring to form a board-to-board connection to mate correctly within a bias for the reason that a conducting pad is adjustable. Thus correct connection is achieved, while assembly steps are simplified, the connection is made adjustable, and manufacturing costs are reduced as well.

A blind mating apparatus according to the present invention is used as an expansion system. The blind mating apparatus includes a first printed circuit board (PCB) and a second PCB. The first PCB has a resilient member and a housing sleeving the resilient member, and the second PCB has a contact member electrically connecting the resilient member. The blind mating apparatus further includes a guiding member for guiding the resilient member and through which the resilient member penetrates. The contact member has a tolerance for correctly mating with the resilient member while the resilient member provides the contact member with a little bias.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

The drawings included herein provide a further understanding of the invention. A brief introduction of the drawings is as follows.

DETAILED DESCRIPTION OF PREFERRED EMBODIMENTS

Figure 1:
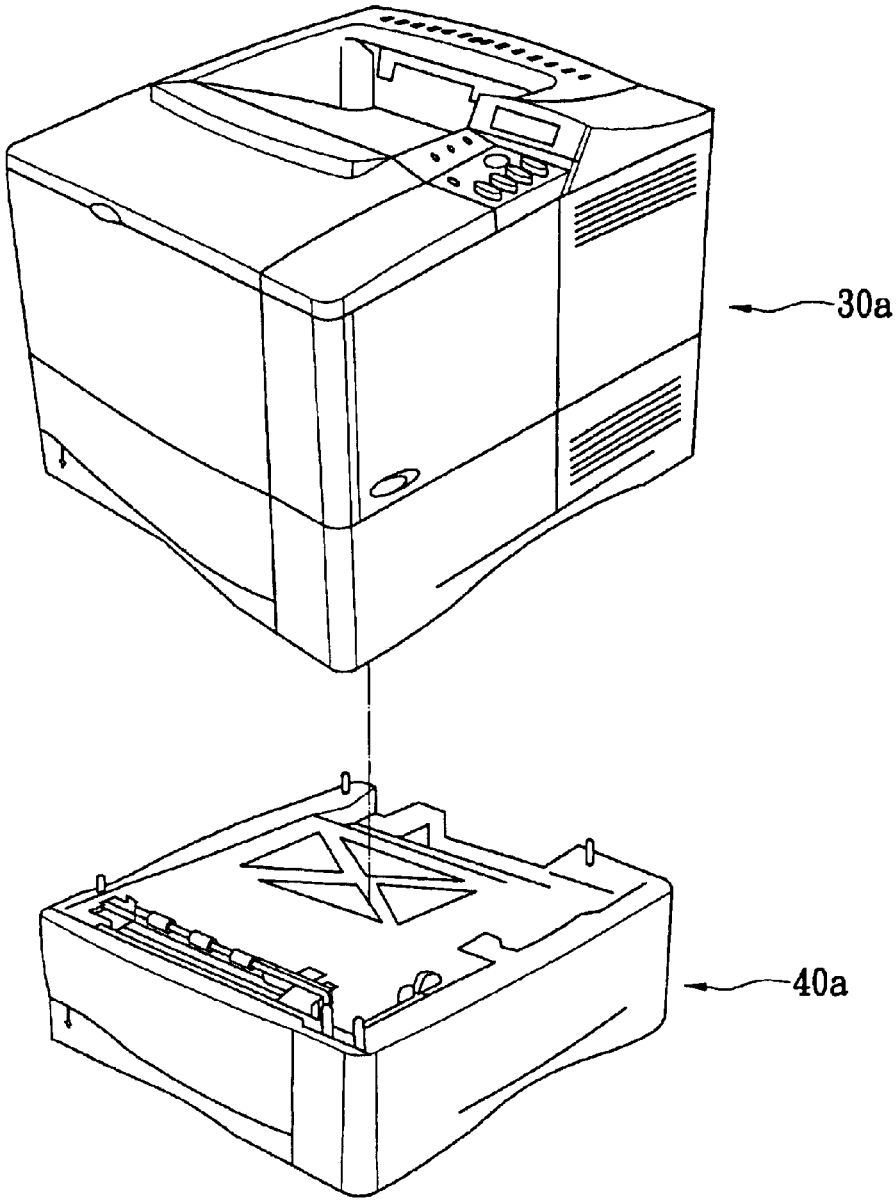
FIG. 1 PRIOR ART
FIG. 1 is a perspective view of a prior art blind mating apparatus.
Figure 2:
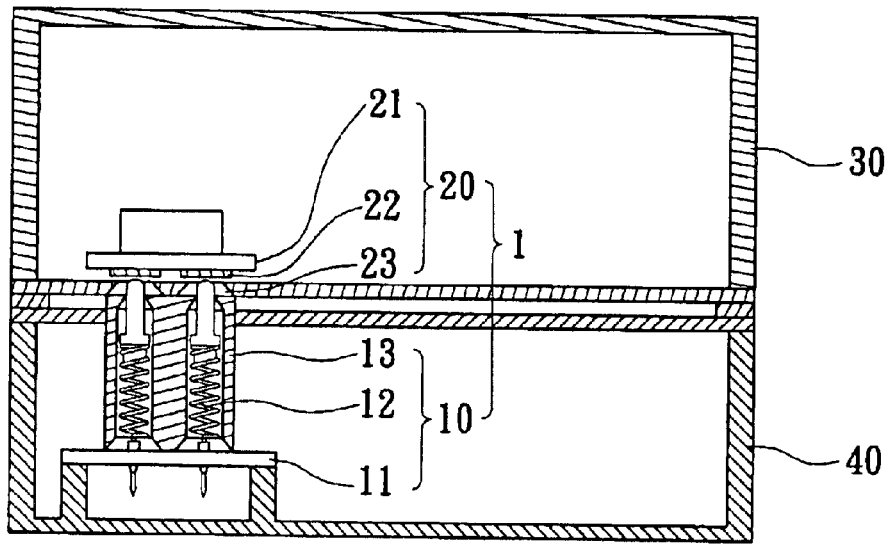
FIG. 2 is a perspective view of a blind mating apparatus of the present invention.
Figure 3:
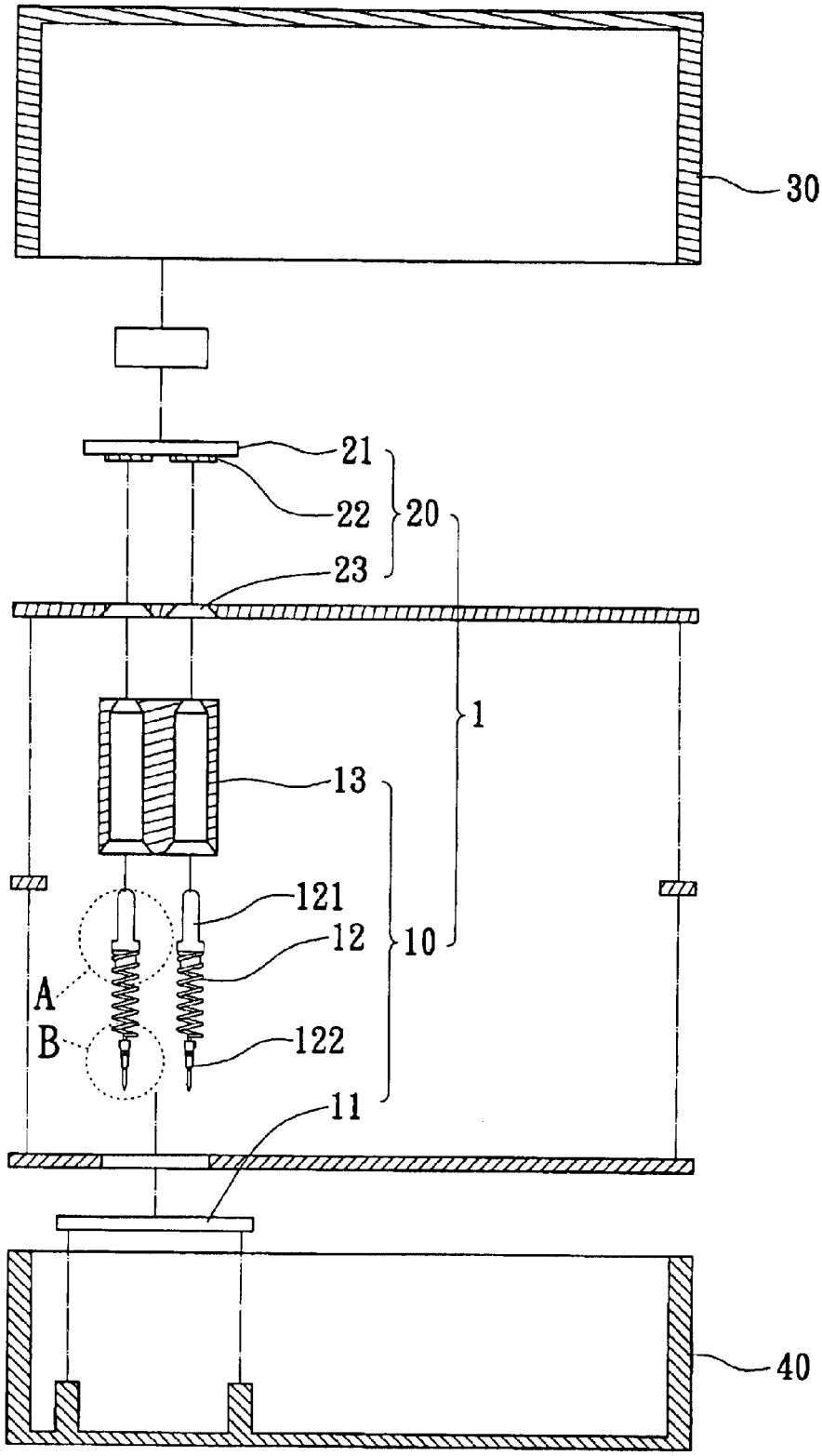
FIG. 3 is a decomposed view of the blind mating apparatus.

Referring to FIG. 2 and FIG. 3, a blind mating apparatus 1 according to the present invention is applied as an expansion system. The expansion system has a first module 30 and a second module 40 expandably mating with the first module 30, the first module 30 and the second module 40 respectively have connecting signals relative to each other. The blind mating apparatus 1 includes a contacting unit 10 and a guiding unit 20 relatively mating with the first module 30 for expandably connecting the second module 40 to the first module 30. The contacting unit 10 includes a first printed circuit board (PCB) 11, a resilient member 12 and a housing 13. The first PCB 11 is located in the second module 40, the resilient member 12 electrically connects to the first PCB 11, and the housing 13 sleeves on the resilient member 12. The guiding unit 20 includes a second PCB 21, a contacting member 22 and a guiding member 23. The second PCB 21 is located in the first module 30. The contacting member 22 is printed on the second PCB 21 and relative to the resilient member 12 for electrically conducting to the resilient member 12. The guiding member 23 corresponds to the resilient member 12 for providing a penetration to the resilient member 12 to electrically conduct to the contacting member 22. The resilient member 12 has a contacting end 121 and a soldering end 122, the soldering end 122 electrically connects to the first PCB 11, the contacting end 121 electrically connects to the contacting member 22 for expandably connecting the second module 40 to the first module 30.

The first module 30 includes a body of an office peripheral system and one expanding paper drawer. The office peripheral system includes a printer, a copier, a fax machine and so on. The second module 40 is another expanding paper drawer.

Figure 4:
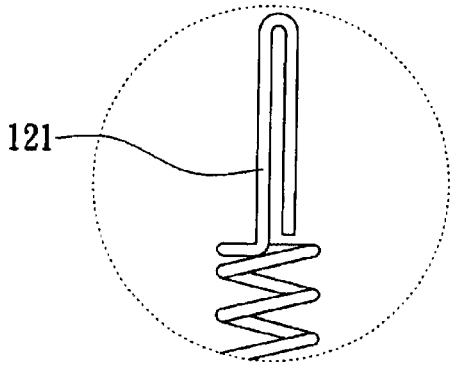
FIG. 4 is an enlarged view according to a first embodiment of part A of a resilient member of the blind mating apparatus of the present invention.
Figure 5:
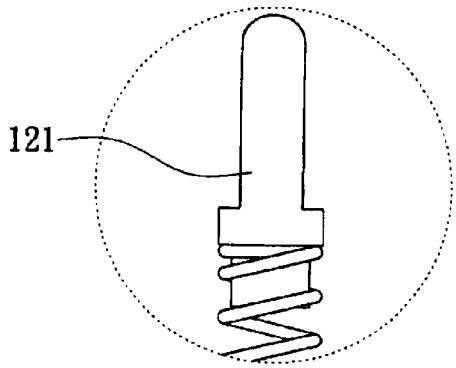
FIG. 5 is an enlarged view according to a first embodiment of part A of the resilient member of the blind mating apparatus of the present invention.
Figure 6:
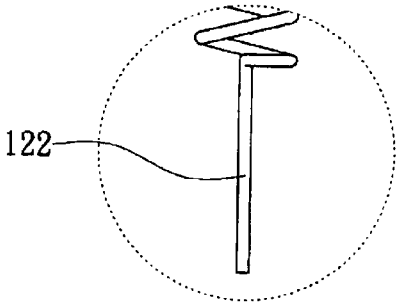
FIG. 6 is an enlarged view according to a first embodiment of Part B of the resilient member of the blind mating apparatus of the present invention.
Figure 7:
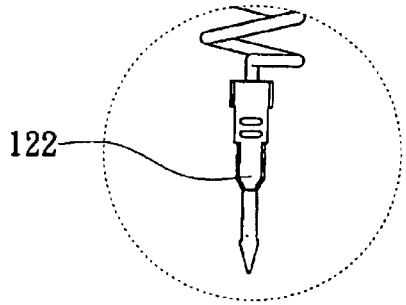
FIG. 7 is an enlarged view according to a first embodiment of Part B of the resilient member of the blind mating apparatus of the present invention.
Figure 8:
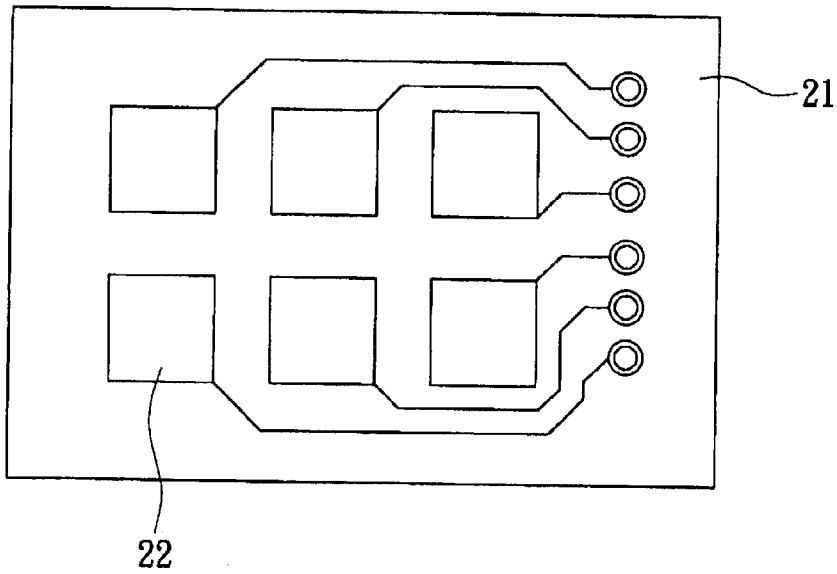
FIG. 8 is a perspective view according to an arrangement of a plurality of contacting members disposed on a second PCB.

The resilient member 12 includes a spring whose size and resilient force varies according to different requirements. Referring to FIG. 4 and FIG. 5, the contacting end 121 is a round end bent from the spring or a metallic stick such as a copper stick. Referring to FIG. 6 and FIG. 7, the soldering end 122 is an end of the spring plated with a tin appetent material or a mating-to-board terminal. The housing 13 is located on the second module 40 or connects to the first PCB 11. The guiding member 23 includes a plurality of openings each relative to the contacting member 22, or the guiding member 23 includes an opening covering the contacting member 22 disposed therein. Referring to FIG. 8, the contacting member 22 includes a plurality of conducting pads, amount and spaces of which vary according to different requirements.

Therefore, the present invention blind mating apparatus 1 utilizes the adjustable size of the contacting member 22 to provide correct connection beyond a little bias for blind mating.

The present invention blind mating apparatus 1 provides board-to-board connection and can serve as a component of the PCBs to communicate signals between the first PCB 11 and the second PCB 21, and further combines with an electric system to achieve simplified assembly steps, a reduced volume thereof, and reduced manufacturing costs.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A blind mating apparatus applied for an expansion system, which has a first module and a second module expandably mating with the first module, and the blind mating apparatus comprising:

a contacting unit having a first printed circuit board (PCB) located in the second module, a plurality of resilient members electrically connecting to the first PCB, and a housing sleeved on each of the resilient members; and a guiding unit relatively mating with the first module for expandably connecting the second module to the first module, and having a second PCB located in the first module, a plurality of contacting members each printed on the second PCB, and a guiding member corresponding to the resilient members, wherein the contacting members are respectively relative to and electrically conducting to the resilient members, and the guiding member is a tapered passageway for providing a penetration to the resilient members to electrically conduct to the contacting members, respectively.

2. The blind mating apparatus of claim 1, wherein the first module includes an expanding paper drawer.

3. The blind mating apparatus of claim 1, wherein the second module includes an expanding paper drawer.

4. The blind mating apparatus of claim 1, wherein the housing connects the second module.

5. The blind mating apparatus of claim 1, wherein the housing connects the first PCB.

6. The blind mating apparatus of claim 1, wherein the guiding member includes an opening covering the resilient members disposed therein.

7. The blind mating apparatus of claim 1, wherein the guiding member includes a plurality of openings respectively relative to the resilient members.

8. The blind mating apparatus of claim 1, wherein the first module includes a body of an office peripheral system.

9. The blind mating apparatus of claim 8, wherein the office peripheral system includes a printer, a copier, and a fax machine.

10. The blind mating apparatus of claim 1, wherein each resilient member has a spring, a soldering end electrically connecting the first PCB, and a contacting end penetrating through the guiding member and electrically connecting a respective contacting member.

11. The blind mating apparatus of claim 10, wherein the soldering end is an end of the spring plated with a tin appetent material.

12. The blind mating apparatus of claim 10, wherein the soldering end is a mating-to-board terminal.

13. The blind mating apparatus of claim 10, wherein the contacting end is a round end bent from the spring.

14. The blind mating apparatus of claim 10, wherein the contacting end is a copper stick.

15. A blind mating apparatus applied for an expansion system, which has a first module and a second module expandably mating with the first module, and the blind mating apparatus comprising:

a first printed circuit board (PCB) located in the second module;

a second PCB located in the first module;

a plurality of contacting members printed on the second PCB, each for providing an electrical connection;

a guiding unit arranged on the first module and being tapered and perforate;

a plurality of resilient members respectively located relative to the contacting members and each having a spring, a soldering end penetrating through the guiding member and electrically connecting the first PCB, and a contacting end electrically connecting the contacting member for expandably connecting the second module to the first module; and a housing sleeved on each of the resilient members.

16. The blind mating apparatus of claim 15, wherein the first module includes an expanding paper drawer.

17. The blind mating apparatus of claim 15, wherein the second module includes an expanding paper drawer.

18. The blind mating apparatus of claim 15, wherein the soldering end is an end of the spring plated with a tin appetent material.

19. The blind mating apparatus of claim 15, wherein the soldering end is a mating-to-board terminal.

20. The blind mating apparatus of claim 15, wherein the contacting end is a round end bent from the spring.

21. The blind mating apparatus of claim 15, wherein the contacting end is a copper stick.

22. The blind mating apparatus of claim 15, wherein the housing connects the second module.

23. The blind mating apparatus of claim 15, wherein the housing connects the first PCB.

24. The blind mating apparatus of claim 15, wherein the guiding member includes an opening covering the resilient members disposed therein.

25. The blind mating apparatus of claim 15, wherein the guiding member includes a plurality of openings respectively relative to the resilient members.

26. The blind mating apparatus of claim 15, wherein the first module includes a body of an office peripheral system.

27. The blind mating apparatus of claim 26, wherein the office peripheral system includes a printer, a copier, and a fax machine.

* * * * *